US007762775B1

(12) United States Patent
Liang

(10) Patent No.: US 7,762,775 B1
(45) Date of Patent: Jul. 27, 2010

(54) TURBINE AIRFOIL WITH COOLED THIN TRAILING EDGE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 612 days.

(21) Appl. No.: 11/809,322

(22) Filed: May 31, 2007

(51) Int. Cl.
*F01D 5/18* (2006.01)

(52) U.S. Cl. ..... 416/97 R

(58) Field of Classification Search ..... 415/115, 415/116; 416/97 R, 96 R
See application file for complete search history.

(56) References Cited

U.S. PATENT DOCUMENTS 4,407,632 A 10/1983 Liang
4,565,490 A 1/1986 Rice
5,931,638 A 8/1999 Krause et al.
6,179,565 B1 * 1/2001 Palumbo et al. ..... 416/97 R
6,234,754 B1 5/2001 Zelesky et al.
6,241,466 B1 6/2001 Tung et al.
6,551,063 B1 4/2003 Lee et al.
6,616,406 B2 9/2003 Liang
6,981,840 B2 1/2006 Lee et al.
7,011,502 B2 3/2006 Lee et al.
7,121,787 B2 10/2006 Jacks et al.
7,198,468 B2 4/2007 Papple

* cited by examiner

*Primary Examiner*—Edward Look
*Assistant Examiner*—Dwayne J White
(74) *Attorney, Agent, or Firm*—John Ryznic

(57) ABSTRACT

A turbine airfoil used in a gas turbine engine in which the airfoil is cooled by passing cooling air through the airfoil. The trailing edge of the airfoil is cooled by a row of metering and diffusion cooling holes connected to a cooling air supply channel arranged along the trailing edge region of the airfoil. Each metering and diffusion cooling holes includes a metering section having a constant area extending along the section, and a diffusion section that is convergent in the airfoil streamwise direction while divergent in the airfoil spanwise direction. The streamwise convergent shape allows for the airfoil trailing edge to be thin, while the divergent spanwise shape allows for the area ratio fro the inlet to the outlet to be from around 5 to 15 such that the cooling flow rate is high and the cooling air is diffused.

10 Claims, 3 Drawing Sheets

TURBINE AIRFOIL WITH COOLED THIN TRAILING EDGE

BACKGROUND OF THE INVENTION

1. Field of the Invention

The present invention relates generally to air cooled turbine airfoils, and more specifically to the cooling of a turbine airfoil trailing edge.

2. Description of the Related Art Including Information Disclosed Under 37 CFR 1.97 and 1.98

In a gas turbine engine, a turbine section includes a plurality of stages of stator vanes and rotor blades to convert chemical energy from a hot gas flow into mechanical energy by driving the rotor shaft. The engine efficiency can be increased by passing a higher gas flow temperature through the turbine section. The maximum temperature passed into the turbine is determined by the first stage stator vanes and rotor blades.

These turbine airfoils (stator vanes and rotor blades) can be designed to withstand extreme temperatures by using high temperature resistant super-alloys. Also, higher temperatures can be used by providing internal convection cooling and external film cooling for the airfoils. Complex internal cooling circuits have been proposed to maximize the airfoil internal cooling while using a minimum amount of pressurized cooling air to also increase the engine efficiency.

Besides allowing for a higher external temperature, cooling of the airfoils reduces hot spots that occur around the airfoil surface and increase the airfoil oxidation and erosion that would result in shorter part life. This is especially critical in an industrial gas turbine engine where operation times between engine start-up and shut-down is from 24,000 to 48,000 hours. Unintended engine shut-down due to a damaged part such as a turbine airfoil greatly increases the cost of operating the engine.

The trailing edge region of airfoils is generally more difficult to cool than other portions of the airfoil because the cooling air is hot when it arrives at the trailing edge since it has been used to cool other portions of the airfoil, and the relative thinness of the trailing edge region limits the rate at which cooling fluid can be passed through that region. In the prior art, the trailing edge channel flow is augmented with pin fins or multiple impingement in conjunction with trailing edge camber line discharge cooling holes to cool the airfoil trailing edge region. FIG. 1 shows a prior art first stage turbine blade cooling circuit for the trailing edge in which a series of pin fins extend between the walls to increase the cooling effectiveness of the circuit. A thicker trailing edge is required to accommodate the use of constant diameter cooling holes for this trailing edge cooling circuit. In some turbine stage blade designs, a large trailing edge thickness may induce high blockage and thus reduce the stage performance.

Size and space limitations make the trailing edge region of gas turbine airfoils one of the most difficult areas to cool. Particularly for the high temperature turbine airfoil cooling application, extensive trailing edge cooling is needed. FIG. 2 shows a prior art first stage blade cooling circuit with the use of pressure side bleeds for the airfoil trailing edge cooling. This type of cooling design used to minimize the airfoil trailing edge thickness has been used in the airfoil trailing edge cooling for the past 30 years. Shortfalls associated with this cooling design is the shear mixing between the cooling air and the mainstream flow as the cooling air exits from the pressure side of the airfoil. The shear mixing of cooling air with the mainstream flow reduces the cooling effectiveness for the trailing edge overhang and therefore induces over temperature at the airfoil trailing edge suction side location.

Frequently this over temperature location becomes the life limiting location for the entire airfoil. A shortened airfoil life results.

Despite the variety of trailing edge region cooling configurations described in the prior art, further improvement is always desirable in order to allow the use of higher operating temperatures, less exotic materials, and reduced cooling air flow rates through the airfoils, as well as to minimize manufacturing costs.

An object of the present invention is to provide for a turbine airfoil with a trailing edge cooling circuit that will improve the trailing edge cooling effectiveness over the cited prior art references.

Another object of the present invention is to provide for a turbine airfoil with a trailing edge cooling circuit that will increase the plugging resistance over the cited prior art references.

Another object of the present invention is to provide for a turbine airfoil with a trailing edge cooling circuit that will reduce the trailing edge thickness and lower the metal temperature of the trailing edge in order to reduce the cooling flow requirement over the cited prior art references.

BRIEF SUMMARY OF THE INVENTION

A turbine airfoil used in a gas turbine engine, the airfoil having a trailing edge cooling circuit in which the cooling holes have a size that allow for the trailing edge to be thin compared to the prior art airfoil. The cooling passages of the present invention include a metering section connected to the cooling air supply cavity and a streamwise convergent and spanwise divergent section downstream from the metering section. Chevron trip strips are located along the walls of the divergent section. The streamwise convergent shape allows for the trailing edge walls to be thinner than in the prior art cooling passages. The spanwise divergent shape allow for the cooling hole to increase in the cross sectional area so that the cooling air flow is sufficient to provide convection cooling for the trailing edge and also provides diffusion of the air flow and minimize plugging.

DETAILED DESCRIPTION OF THE INVENTION

Figure 1:
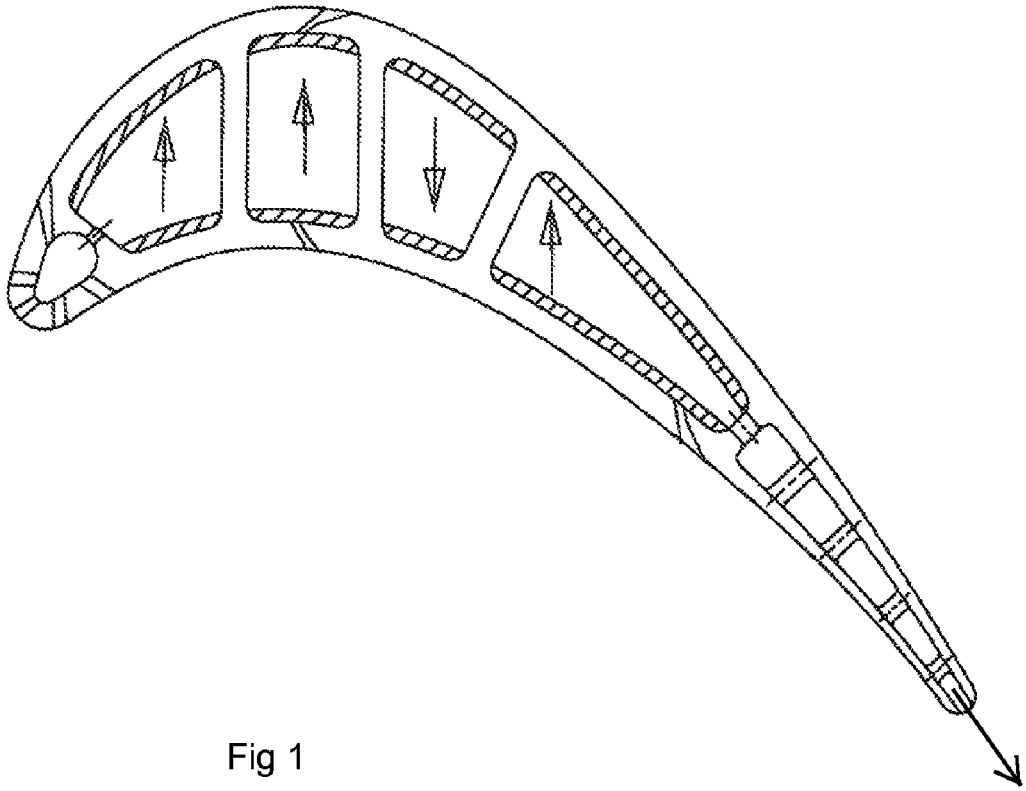
Fig 1 prior art
FIG. 1 shows a cross section view of a prior art turbine blade with a trailing edge cooling passage having pin fins.
Figure 2:
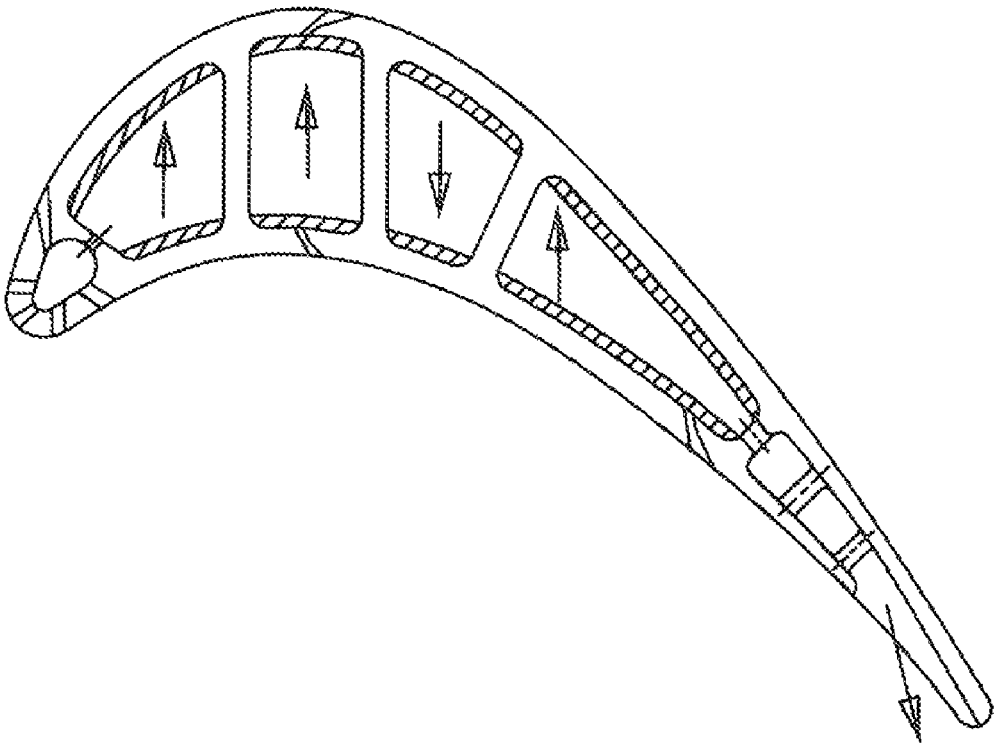
Fig 2 prior art
FIG. 2 shows a cross section view of a prior art turbine blade with a trailing edge cooling passage pin fins and a pressure side slot.

The present invention is a turbine airfoil, such as a rotor blade or a stator vane, for use in a gas turbine engine in which the airfoil requires passing cooling air through the airfoil to produce convection and film cooling. the first embodiment of the present invention is a turbine rotor blade with an internal cooling circuit having a trailing edge cooling supply channel positioned along the trailing edge to deliver cooling air to the trailing edge. FIG. 1 shows a cross section view along the streamwise direction (from the pressure side to the suction side) of the blade. The cooling supply channel 11 extends along the trailing edge region of the airfoil, and a row of trailing edge cooling holes connect to the cooling supply channel 11 and discharge cooling air out exit holes or slots 15 positioned on the edge or on the pressure or suction side wall adjacent to the edge of the airfoil.

The cooling passage includes a metering section 12 connected to the cooling supply channel 11, the metering section 12 having a constant diameter from the inlet A1 to the outlet A2 of this section and a length L1. in the metering section 12, the ratio of length to diameter (L/D) is from about 2 to about 3.

Figure 3:
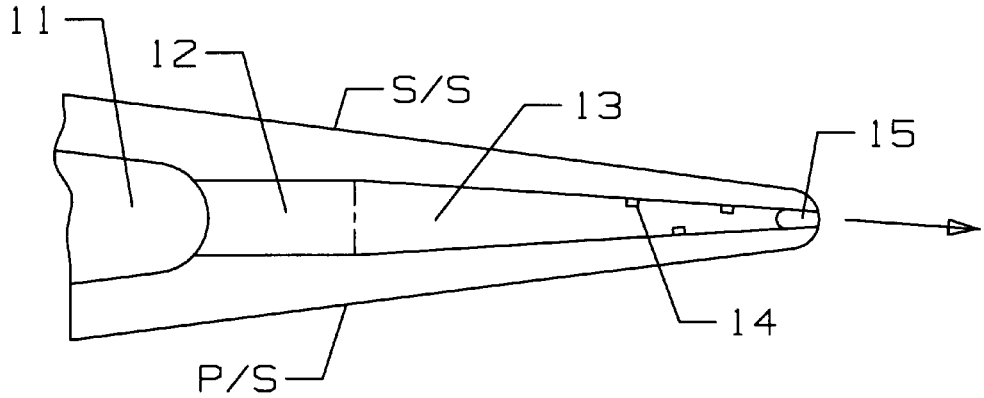
FIG. 3 shows a streamwise cross section view of the trailing edge cooling channel of the present invention.
Figure 4:
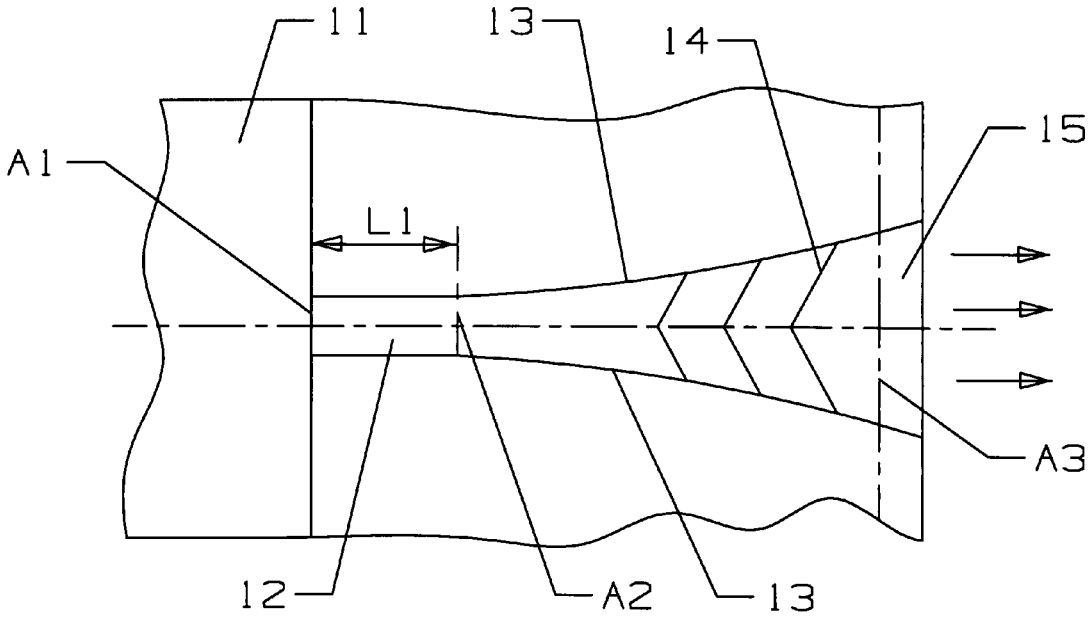
FIG. 4 shows a spanwise cross section view of the trailing edge cooling channel of the present invention.

Downstream from the metering section 12 is a diffusion section 13 which has a streamwise convergent shape in the streamwise direction as seen in FIG. 3 and a spanwise divergent shape as seen the FIG. 4. From the inlet A2 to the outlet A3 of the diffusion section, the side walls narrow in the streamwise direction and diverge or open in the spanwise direction. The top walls of the cooling channel 13 shown in FIG. 4 have a slight outward curvature instead of being straight. The spanwise divergent angle is from about 10 degrees to about 30 degrees which represents the wall curvature from the axial line through the cooling passage. The wall curvature grows from around 10 degrees at the inlet end to around 30 degrees at the exit end of the diffusion section 13. The ratio A3/A2 of the inlet area A2 to the outlet area A3 of the divergent section 13 is from about 5 to about 15. The side walls of the divergent section of the cooling channel include chevron trip strips 14 to promote the heat transfer effect. FIG. 3 shows the trips strips 14 alternating from the pressure side wall to the suction side wall to produce a serpentine flow path within the channel. The outlet of the divergent section 13 opens into a spanwise continuous slot 15 as shown in FIG. 4. The divergent section 13, because the exit area A3 is larger than the inlet area A2, produces a diffusion effect in the cooling fair flow.

There is a limitation of how large the cooling channel area can be expanded prior to flow separation occurring within the cooling channel. Normally an exit area to cooling flow metering area ratio for a prior art metering diffusion hole is at 3 to 5 to produce a good expansion ratio. For the present invention with the convergent and divergent cooling channel, the expansion ratio can be greater than 5 to an area ratio as high as 15, especially for a continuous curved side wall used for the divergent section 13.

A diffusion angle in the range of 10 to 30 will be considered acceptable for the cooling flow expansion without inducing flow separation within the cooling flow channel. A typical diffusion angle for a metering diffusion slot is at 7 to 10 degrees. Preferably, the sidewall is in a double radius of curvature with a continuous curved sidewall. The first continuous curve is for the metering section followed by the second continuous curve for the spanwise expansion area section which is at no less than streamwise convergent area reduction.

A constant cross section area inlet portion at length of 2 to 3 ratio to the cooling channel inlet diameter will be required for metering the cooling flow rate.

The sidewall of the trailing edge cooling channel is converged continuously at the same wedge angle as the airfoil trailing edge.

Thus, the trailing edge cooling channels of the present invention provide for a metering, streamwise convergent and spanwise divergent and diffusion cooling effect to provide the proper cooling for the airfoil trailing edge exit region. The cooling slot of the present invention includes a constant diameter entrance section for the metering of cooling flow rate. Downstream from the metering section is an accelerating cooling flow section. The cooling channel is convergent continuously at the same angle as the airfoil wedge angle or parallel with the airfoil contours. This streamwise convergent flow channel is designed with a continuous spanwise divergent section. the divergent section is then diffusing the cooling flow into a spanwise continuous slot to minimize the airfoil coat down or plugging issue.

In addition, the continuous spanwise divergent section can be designed to maintain the constant flow area as the rate of chordwise convergent or additional expansion in the spanwise divergent can also be considered. Basically the trailing edge cooling channel is transformed from a circular diameter at the inlet section to a spanwise elongated race track slot then follows by a continuous spanwise diffusion slot. Chevron trip strips can be incorporated in the convergent and divergent trailing edge cooling channel at the very exit region, where the heat load is high for the airfoil trailing edge, to minimize the internal heat transfer performance.

As a result of the inlet metering, streamwise convergent, spanwise divergent and diffusion cooling channel of the present invention, an improvement for the airfoil trailing edge cooling can be achieved over the cited prior art. A thinner airfoil trailing edge with a minimal aero blockage as well as a maximum trailing edge cooling can be achieved as well.

I claim the flowing:

1. A turbine airfoil for use in a gas turbine engine, the airfoil comprising: a leading edge and a trailing edge; a pressure side and a suction side extending between the leading and trailing edges; a cooling air supply channel extending along a trailing edge region of the airfoil; and a plurality trailing edge cooling holes connected to the cooling air supply channel and opening onto the trailing edge region of the airfoil, each of the trailing edge cooling hole comprising a diffusion section having a streamwise convergent side and a spanwise divergent side.

2. The turbine airfoil of claim 1, and further comprising: a metering section located upstream of the diffusion section, the metering section having a constant cross sectional area from the inlet to the outlet of the metering section.

3. The turbine airfoil of claim 2, and further comprising: the metering section having a length to diameter ratio of from around two to around three.

4. The turbine airfoil of claim 1, and further comprising: the diffusion section having the streamwise convergent side with walls that are formed substantially parallel to the pressure and suction side walls of the airfoil.

5. The turbine airfoil of claim 1, and further comprising: the diffusion section having the spanwise divergent side formed from walls that diverge from around 10 degrees to around 30 degrees.

6. The turbine airfoil of claim 1, and further comprising: the diffusion section includes chevron trip strips formed on the side walls adjacent to the pressure and suction side walls of the airfoil.

7. The turbine airfoil of claim 6, and further comprising: the chevron trip strips alternate between the pressure side wall and the suction side wall such that the cooling air flows in a wavy flow path through the trip strips.

8. The turbine airfoil of claim 6, and further comprising: the trip strips are formed on the aft ends half of the diffusion section.

9. The turbine airfoil of claim 1, and further comprising: an area ratio of the diffusion section outlet to inlet is from about 5 to about 15.

10. The turbine airfoil of claim 1, and further comprising: the diffusion section opens into a continuous slot formed along the pressure side of the airfoil.

* * * * *